US007549386B2

(12) United States Patent
Bertin

(10) Patent No.: US 7,549,386 B2
(45) Date of Patent: Jun. 23, 2009

(54) ELECTRICALLY ACTUATED APPARATUS FOR MOVING SUPPORTS CARRYING SENSORS AND THE LIKE IN SUBMARINES

(75) Inventor: Daniele Maria Bertin, Milan (IT)

(73) Assignee: Calzoni S.r.l., Calderara Di Reno (Bolonga) (IT)

( * ) Notice: Subject to any disclaimer, the term of this patent is extended or adjusted under 35 U.S.C. 154(b) by 0 days.

(21) Appl. No.: 11/737,810

(22) Filed: Apr. 20, 2007

(65) Prior Publication Data

US 2007/0283872 A1 Dec. 13, 2007

(30) Foreign Application Priority Data

Apr. 21, 2006 (IT) ..... MI2006A0799

(51) Int. Cl.
*B63G 8/40* (2006.01)

(52) U.S. Cl. ..... 114/328

(58) Field of Classification Search ..... 114/328, 114/312; 343/709

See application file for complete search history.

(56) References Cited

U.S. PATENT DOCUMENTS 3,363,228 A * 1/1968 Massa ..... 367/161
5,128,688 A * 7/1992 West ..... 343/766
5,749,273 A * 5/1998 Rimlinger, Jr. ..... 82/1.11
6,335,708 B1 * 1/2002 Coleman ..... 343/877
2004/0136849 A1 * 7/2004 Du et al. ..... 417/423.11
2005/0115781 A1 * 6/2005 Mourad et al. ..... 188/157

* cited by examiner

*Primary Examiner*—Stephen Avila
(74) *Attorney, Agent, or Firm*—Timothy J. Klima

(57) ABSTRACT

Apparatus for moving supports carrying sensors displaceable inside fixed guides integral with the towers of submarines, and the like, upon operation of an actuator, the actuator consisting of an electric motor coupled to one end of a screw actuator on which a screw nut integral with a rod is movable, the entire assembly being contained inside a housing with seals, from which the free end of said rod protrudes for fastening to the tube. The housing can include a first bearing and a second bearing or bushing for supporting the rod and the screw actuator coaxially within the housing. The housing can include a top chamber above the first bearing and a bottom chamber below the first bearing. One or both of the chambers can be filled with lubricating oil to dissipate heat and/or dampen noise. The bottom chamber can house the motor and include a dielectric oil. The motor can be controlled by an electronic actuating system using an angular position transducer. The system can also include a braking circuit for braking the motor and a circuit that provides resistance or short-circuits the windings of the motor to cause a gradual downward movement of the support in the event of a power failure.

20 Claims, 1 Drawing Sheet

ELECTRICALLY ACTUATED APPARATUS FOR MOVING SUPPORTS CARRYING SENSORS AND THE LIKE IN SUBMARINES

CROSS REFERENCE TO RELATED APPLICATIONS

Italian Patent Application No. MI2006A 000799, filed 21 Apr. 2006, which is hereby incorporated by reference.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

1. Field of the Invention

The present invention relates to an apparatus for moving supports for sensors or the like in submarines, which comprises actuating means of the electrical type.

2. Description of Related Art

It is known in the technical sector of submarines that there is a need to raise above the surface of the water, when the submarine is at periscope height, a certain number of sensors of the passive and active type, such as radar and/or radio antennae, optronic heads and the like which are normally housed inside the tower (or sail) of the submarine and fixed to displaceable tubes and which, when required, are displaced vertically by suitable hydraulic raising devices until they are brought outside the free surface of the water situated above the tower.

It is also known that these vertical displacement apparatus must be particularly silent in order to avoid detection by means of acoustic signals, able to withstand the pressure underwater produced at the navigation depth of the submarine, resistant to corrosion by the seawater and able to raise the sensor-support tube, overcoming not only the weight thereof, but also the friction produced by the hydrodynamic thrust of the water, owing to the movement of the submarine, on the guides for sliding of the said tube, which transverse thrust is responsible for most of the overall resistance to displacement in the vertical direction.

For this purpose, apparatus which envisage the use of oil-dynamic actuating systems are known in the art, said systems, however, requiring a hydraulic system comprising among other things a pumping station with consequent constructional complications and an increase in the maintenance requirements in order to protect the purity of the oil from water infiltration.

In addition to this, the hydraulic cylinder actuating system has further drawbacks such as the large weight of the actuator and the associated hydraulic circuit, the need to convert the power from its electrical form available on-board into a hydraulic form with associated devices and loss of efficiency, and the sensitivity of the position transducer to electromagnetic disturbances since they are situated in the vicinity of the displaced sensor which may be a broadcasting antenna.

SUMMARY

The technical problem which is posed, therefore, is that of providing an apparatus for raising sensor support tubes in submarines, which is particularly silent, corrosion-resistant and not sensitive to electromagnetic disturbances, has small dimensions, is easy and inexpensive to produce and assemble and can be easily installed on any submarine with a small number of operations to be performed in loco.

These results are achieved according to the present invention by an apparatus for moving supports for submarine sensors displaceable on guides, within fixed guides integral with the tower of submarines and the like, upon operation of an actuator consisting of at least one electric motor which is coupled to one end of a screw actuator to which a screw nut integral with a rod is connected, the entire assembly being contained inside a sealed housing from which the free end of said rod protrudes for fastening to the tube to be moved.

DESCRIPTION OF THE DRAWINGS

Further details may be obtained from the following description of a non-limiting example of embodiment of the subject of the present invention provided with reference to the accompanying drawings, in which.

DETAILED DESCRIPTION OF THE INVENTION

Figure 1:
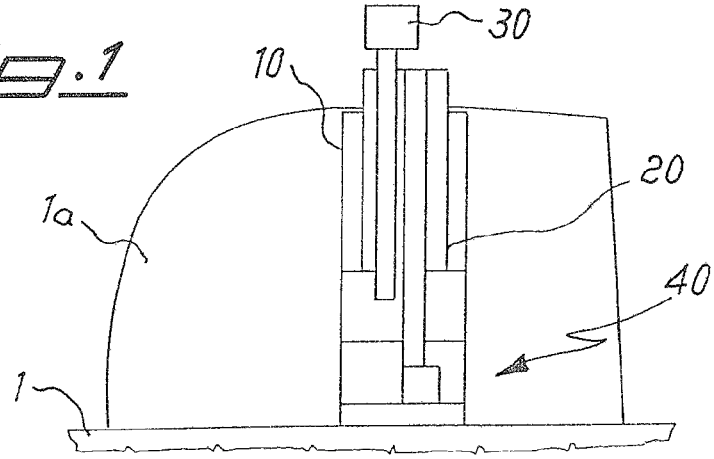
FIG. 1 shows a schematic cross-section along a vertical plane of the tower of a submarine with associated tube housed inside the sliding guide.

As shown in FIG. 1, a conventional apparatus for moving tubes 20 carrying sensors 30 (antennae, periscopes, etc.) and snorkel, contained inside towers 1*a* integral with the body 1 of submarines, comprises a fixed guide 10 which has, displaceable inside it in the longitudinal direction, a tube 20 which carries the sensors 30 and is operated by means of an actuator 40.

Figure 2:
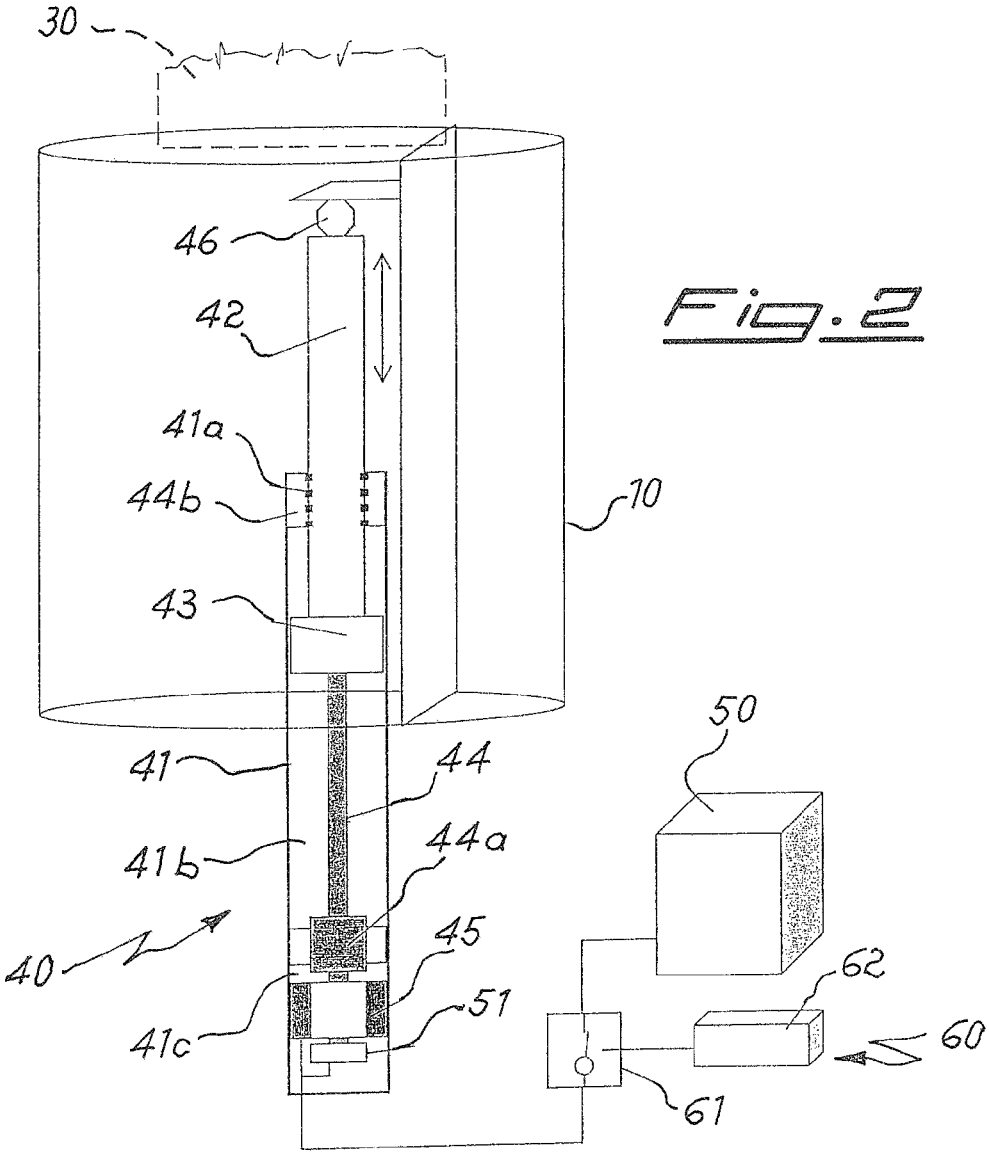
FIG. 2 shows a schematic view of the device according to the present invention for actuating a tube of a submarine.

According to the invention (FIG. 2) it is envisaged that said actuator 40 consists of a sealed housing 41 seating internally a rod 42 which protrudes from the housing through seals 41*a* under pressure so as to ensure a hermetic seal; the end of the rod 42, which is inside the housing 41, is connected to the screw nut 43 of a screw actuator 44 in turn connected to a rotating electric motor 45 directly coupled to the said screw.

The electric motor 45 is controlled by a special electrical actuating system 50 via an angular position transducer 51. The rotary movement of the screw 44 is supported by first bearings—or bushings—44*a* which are fixed to the housing 41 in the vicinity of the motor 45 and by second bearings 44*b* which are arranged at the top end of the said housing.

Inside the housing 41, hermetic sealing of which is ensured by the seals 41*a*, two chambers 41*b*, 41*c* are formed, above and below the bearings 44*a*, respectively.

Said two chambers may contain oils, also with different and suitable characteristics for lubricating the seals 41*a* and/or dissipating the heat and/or damping the noise.

In particular the oil of the bottom chamber 41*c* containing the motor is a dielectric oil.

The end of the rod 42 outside the housing 41 is connected to the tube 10 by means of a joint 46 which may consist of a resilient acceleration damping device so as to be able to withstand the accelerations.

According to a preferred embodiment, the device also envisages control means 60 for performing a gradual downward movement of the tube 10 in the event of a power failure; said means comprise:

an electric switch 61 operated so as to connect the power supply circuit to a unit 62 for resisting or short-circuiting the windings of the motor in order to create a torque opposing the movement (operation of the motor as a generator).

With this configuration a gradual downward movement of the tube 42 is ensured in the event of an emergency and without the need for auxiliary power.

It is therefore clear how the apparatus for moving sensor support tubes of submarines according to the invention is particularly silent, low-cost in terms of maintenance and compatible with the direct electric power available on-board the submarine, highly flexible for controlling the movement and optimizing the acceleration/braking of the tube, and has a lower weight since the hydraulic circuit has been eliminated and a low sensitivity to the electromagnetic disturbances since the position transducer is incorporated in the actuator situated at a distance from the radiofrequency signal source.

With the apparatus, moreover, it is possible to obtain a further advantage consisting in the fact that, since the actuator for moving the tube 20 is incorporated partly inside the tube and partly inside the guide, complete assembly may be performed at the factory and installation of the pre-assembled assembly on the submarine may be performed using the so-called "cartridge" technique, with obvious advantages in terms of precision, simplicity and cost savings.

What is claimed is:

1. An apparatus for moving a support carrying at least one sensor displaceable inside fixed guides of a tower of a submarine comprising:

an actuator, said actuator including an electric motor, a screw actuator coupled at one end to the electric motor to be rotationally driven by the electric motor, a screw nut threadingly engaged with the screw actuator to be axially moved when the screw actuator is rotationally driven, a rod connected to the screw nut for axial movement with the screw nut;

a housing for containing the actuator; and at least one seal sealing between the housing and the rod for preventing water from getting inside said housing, a free end of the axially movable rod protruding through the at least one seal being connectable to the support for axially moving the support within the tower.

2. An apparatus according to claim 1, further comprising a resilient acceleration damping device connecting said rod to the support.

3. An apparatus according to claim 1, wherein the at least one seal are under pressure and create a hermetic seal between the rod and the housing.

4. An apparatus according to claim 1, wherein the screw actuator is supported for rotation by a first bearing which is fixed to the housing adjacent the motor and by a second bearing/bushing which is arranged at a top end of the said housing.

5. An apparatus according to claim 4, wherein the housing includes a top chamber and a bottom chamber, each containing a lubricating fluid, the top chamber being disposed above the first bearing and the bottom chamber being disposed below the first bearing.

6. An apparatus according to claim 5, wherein the lubricating fluid in at least one of said chambers dissipates heat.

7. An apparatus according to claim 5, wherein the lubricating fluid in at least one of said chambers dampen noise.

8. An apparatus according to claim 5, wherein the bottom chamber contains the electric motor and the lubricating fluid in the bottom chamber is a dielectric oil.

9. An apparatus according to claim 1, and further comprising an electric actuating system and an angular position transducer for controlling the electric motor.

10. An apparatus according to claim 1, wherein the electric motor is operable in a generator mode to apply a controlled braking effect against the screw actuator, thereby counteracting a retracting force acting on the axially movable rod and allowing a controlled retraction of the axially movable rod in an event where the electric motor cannot be operated in the driving mode.

11. An apparatus according to claim 10, and further comprising:

at least one component connectable to the electric motor and operable in at least one of a windings resistive mode and a windings short-circuiting mode to operate the electric motor in the generator mode;

at least one electric switch for connecting the at least one component to the electric motor to operate the electric motor in the generator mode.

12. An apparatus for moving at least one sensor between a retracted position and an extended position with respect to a submarine tower, comprising:

a linear actuator having a linearly movable member connectable to the support for linearly moving the support and sensor between the retracted position and the extended position with respect to the submarine tower;

an electric motor connected to the linear actuator and selectively operable in a driving mode for driving the linear actuator to linearly move the linearly movable member;

wherein the electric motor is also selectively operable in a generator mode to apply a controlled braking effect against the linear actuator, thereby counteracting a retracting force acting on the linearly movable member and allowing a controlled retraction of the linearly movable member, the support and the sensor in an event where the electric motor cannot be operated in the driving mode.

13. An apparatus according to claim 12, and further comprising:

at least one component connectable to the electric motor and operable in at least one of a windings resistive mode and a windings short-circuiting mode to operate the electric motor in the generator mode;

at least one electric switch for connecting the at least one component to the electric motor to operate the electric motor in the generator mode.

14. An apparatus for moving a support carrying at least one sensor displaceable inside fixed guides of a tower of a submarine, comprising:

a rod axially movable between a retracted position and an extended position, the axially movable rod connectable to the support;

an actuator for axially moving the axially movable rod, the actuator comprising:

a screw actuator;

an electric motor coupled to one end of the screw actuator and operable in a driving mode to rotationally drive the screw actuator;

a screw nut threadingly coupled to the screw actuator to be axially moveable when the screw actuator is rotated, the screw nut connected to the axially movable rod for axially moving the rod, the support and the sensor with respect to the tower of the submarine when the screw actuator is rotated;

a housing within which the actuator is positioned, a portion of the axially movable rod that is connectable to the support extending beyond the housing in at least the extended position;

at least one seal positioned between the housing and the axially movable rod for creating a seal therebetween and preventing water from entering the interior of the housing and contacting the actuator.

15. An apparatus according to claim 14, wherein the electric motor is operable in a generator mode to apply a controlled braking effect against the screw actuator, thereby counteracting a retracting force acting on the axially movable rod and allowing a controlled retraction of the axially movable rod in an event where the electric motor cannot be operated in the driving mode.

16. An apparatus according to claim 15, and further comprising:

at least one component connectable to the electric motor and operable in at least one of a windings resistive mode and a windings short-circuiting mode to operate the electric motor in the generator mode;

at least one electric switch for connecting the at least one component to the electric motor to operate the electric motor in the generator mode.

17. An apparatus according to claim 14, wherein the screw actuator is supported for rotation by a first bearing which is fixed to the housing adjacent the motor and by a second bearing which is arranged at a top end of the housing.

18. An apparatus according to claim 17, wherein the housing includes a top chamber and a bottom chamber, each containing a lubricating fluid, the top chamber being disposed above the first bearing and the bottom chamber being disposed below the first bearing.

19. An apparatus according to claim 18, wherein the bottom chamber contains the electric motor and the lubricating fluid in the bottom chamber is a dielectric oil.

20. An apparatus according to claim 14, and further comprising an electric actuating system and an angular position transducer for controlling the electric motor.

* * * * *